US006144836A

United States Patent [19]

Umeda et al.

[11] Patent Number: 6,144,836

[45] Date of Patent: Nov. 7, 2000

[54] ELECTROSTATOGRAPHIC PRINTING MACHINE

[75] Inventors: Takao Umeda; Akio Tsujita; Takashi Rokutanda; Yukio Otome, all of Ibaraki, Japan

[73] Assignee: Hitachi Koki Co., Ltd., Tokyo, Japan

[21] Appl. No.: 08/925,763

[22] Filed: Sep. 9, 1997

[30] Foreign Application Priority Data

Sep. 19, 1996 [JP] Japan ..... 8-247597

[51] Int. Cl.[7] ..... G03G 15/00; G03G 21/00

[52] U.S. Cl. ..... 399/400; 399/397; 399/306

[58] Field of Search ..... 399/397, 299, 399/300, 306, 364, 384, 385, 386, 387, 400

[56] References Cited

U.S. PATENT DOCUMENTS

| | | | |
|---|---|---|---|
| 5,264,902 | 11/1993 | Suwa et al. . | |
| 5,287,153 | 2/1994 | Senba . | |
| 5,331,385 | 7/1994 | Ohtsuka et al. | 399/331 |
| 5,623,719 | 4/1997 | De Cock et al. | 399/299 |
| 5,723,214 | 3/1998 | Yamazaki et al. | 492/56 X |
| 5,725,922 | 3/1998 | Nakamura et al. | 492/56 X |

FOREIGN PATENT DOCUMENTS

| | | |
|---|---|---|
| 0 631 204 A1 | 12/1994 | European Pat. Off. . |
| 41 01 474 A1 | 7/1991 | Germany . |
| 5-216363 | 8/1993 | Japan . |
| 7-72776 | 3/1995 | Japan . |

*Primary Examiner*—Richard Moses

*Attorney, Agent, or Firm*—Sughrue, Mion, Zinn, Macpeak Seas, PLLC

[57] ABSTRACT

A transport roll 1 consists of a metal roll 3 of 40 mm in diameter covered with a conductive PFA tube 2 of $10^{10}$ Ωcm in volume resistivity and 200 μm in thickness. A DC voltage source 4 is connected to the metal roll. A sheet of paper 5 bearing toner images 6 and 7 on both sides thereof receives a drive force from a paper drive roll, and turns with the movement of the paper. The DC voltage source produces voltage VB1 of the same polarity as the charging polarity (positive) of the toner image 6 being in contact with the transport roll. The voltage VB1 is optimumly controlled so as to prevent the transport roll from being soiled with toner.

4 Claims, 5 Drawing Sheets

ELECTROSTATOGRAPHIC PRINTING MACHINE

BACKGROUND OF THE INVENTION

1. Field of the Invention

The present invention relates to an electrostatographic printing machine of the duplex copying type, and more particularly to an electrostatographic printing machine which forms toner copies of images on both sides of a print sheet of paper, and fuses and permanently fixes the toner copies onto both sides of the print sheet by a fusing unit, a roll biased for paper transportation being provided between the transfer unit and the fusing unit of the printing machine.

2. Description of the Related Art

In the field of printers, copying machines and the like, the need of the duplexing printing in which images, for example, are printed on both sides of a print substrate is increasing on social and market demands for saving resources and reducing the cost of transporting printed matters. The continuous paper printer employs a called tandem printing system. In the tandem printing system, two laser printers are used. A first laser printer prints a toner image on one side of the print substrate and a second one does the other side of the substrate. Recently, an attraction has paid to a printing system in which unfixed toner powder images are formed on both sides, and those toner images are simultaneously fused and fixed on both sides of the print substrate. A construction of this simultaneous duplexing printing type is schematically illustrated in FIG. 6. Description will be given using a printing unit which uses a positively charged photosensitive drum of SeTe or $As_2Se_3$ for a photo receptor, and positively charged toner powder. In the printing unit, positive charges are applied to a photo receptor 23*a* by means of a corona charger 24*a*, a light pattern is irradiated onto the photo receptor 23*a* in an exposure unit 25*a* including a laser optical system, an LED, and the like, to thereby form a latent electrostatic image thereon. The latent image is developed into a toner image 7 by a developing unit 26*a*. A corona charging unit 27*a* applies negative charges to the reverse side of a print sheet of paper 5. The toner image 7 is transferred to the print sheet of paper 5, from the photo receptor 23*a*. The printing unit having the function stated above is referred to as a first printing unit. A toner polarity reversing device, which consists of a combination of a negatively charging corona charger 28 and a positively charging corona charger 29, reverses the polarity of the positively charged toner image 7. A second printing unit consisting of a photosensitive drum 23*b* transfers a positively charged toner image 6 on the reverse side of the sheet 5 in a similar way. As a result, the toner images 6 and 7 of different polarities are formed on both sides of the sheet 5. The toner images 6 and 7 are fused by heat radiated from a non-contact heating device 31 formed of an infrared lamp 30 and a reflecting plate, and fixed on the paper. In the figure, reference numeral 1 designates a transport roll 1, and 32 is a paper transport drive roll. The transport roll 1 is used for changing the direction of transporting a continuous paper and serves also as a buffer when the paper is transported. In this respect, this roll is an essential component part. The transport roll 1 comes in contact with an unfixed toner image. Therefore, there is the possibility that the surface of the transport roll is soiled with toner, and the toner image is disarranged. Japanese Patent Laid-Open Publication No. Hei. 7-072776 discloses a technique to solve the problem. In the publication, as shown in FIG. 7, a teflon coating 33 is formed on the surface of a metal roll 3. Charges of the same polarity (positive polarity in FIG. 7) as the charging polarity of the toner image 6 are applied to the surface of the teflon coating 33 by a corona charger 13, whereby making it hard for the toner image 6 to attach to the transport roll surface. Reference numeral 9 designates a cleaning means for cleaning the transport roll 1.

In a technique disclosed in Japanese Patent Laid-Open Publication No. Hei. 5-216363, an input roller made of conductive PFA is located at the extreme end of the transport guide, and a print substrate is transported to the fusing unit by the input roller.

In the publication No. Hei. 7-072776, as shown in FIG. 7, the teflon coating 33 is of the insulation nature. Because of this, charge from the corona charger 13 is accumulated in the teflon coating, a surface potential of the transport roll increases, and in an extreme case, the accumulated charge is discharged. "Disarrangement of the toner image and the background of the image", which are caused by the surface potential increase owing to the accumulated charges, will be described with reference to FIG. 8.

Generally, the discharging along the corona wire is not always uniform. In a location on the teflon coating 33 where charge 17 is increased in amount, the toner particles of a toner image 6' on the sheet 5 receives a strong repulsion from the transport roll surface, and are scattered. The toner particles 7' also undergoes an abrupt change in the potential distribution, so that the toner particles are scattered. It is found that these phenomena disarranges the toner image and creates a fog on the background. In the case of a line image of which the amount of toner attached thereto is larger than a solid image, an amount of its toner is large. A nonuniformity of the transport potential on the transport roll greatly affects the scattering of toner particles. To avoid this, it is essential to uniformize the surface potential on the transport roll surface. It is also found that to secure a stable paper transporting, it is necessary 1) to reduce an attaching force of toner particles to the transport roll surface and 2) to increase an attaching force of it to the paper.

In the publication No. Hei. 5-216363, a print substrate enters the fusing unit by way of a transport guide and a small input roller. At this time, toner attaches to the input roller, and the attached toner particles enter a gap between the input roller and the transport guide. The result is to impede the rotation of the input roller and sometimes soils the paper.

SUMMARY OF THE INVENTION

The present invention has been made to solve the above problems, and therefore an object of the invention is to provide an electrostatographic printing machine and a transport roll used in the machine, being capable of stabilizing of a surface potential of the transport roller, and reducing an attaching force of toner to the transport roll surface and increasing an attaching force of toner to the paper.

To achieve the above object, according to the invention, there is provided an electrostatographic printing machine in which unfixed toner images are formed on both sides of a sheet of paper in a transfer unit, and the unfixed toner images are fused and fixed on both sides of the sheet, and a transport roll for changing the direction of transporting the sheet and/or serving as a buffer is provided between the transfer unit and the fusing unit, the improvement characterized in that said transport roll consists of a metal roll covered with a conductive fluoroplastic layer, and a DC voltage whose polarity is the same as the charging polarity of a toner image being in contact with said transport roll is applied to the metal roll of said transport roll.

Also, according to the invention, there is provided a transport roll being covered with a conductive fluoroplastic layer of $10^7$ to $10^{12}$ Ωcm in volume resistivity.

The above and other objects and features of the present invention will be more apparent from the following description taken in conjunction with the accompanying drawings.

DETAILED DESCRIPTION OF THE PREFERRED EMBODIMENTS

Now, a description will be given of the stabilization of a surface potential of the transport roller.

A construction of transport roll according to the present invention will be described with reference to FIG. 2.

Figure 2:
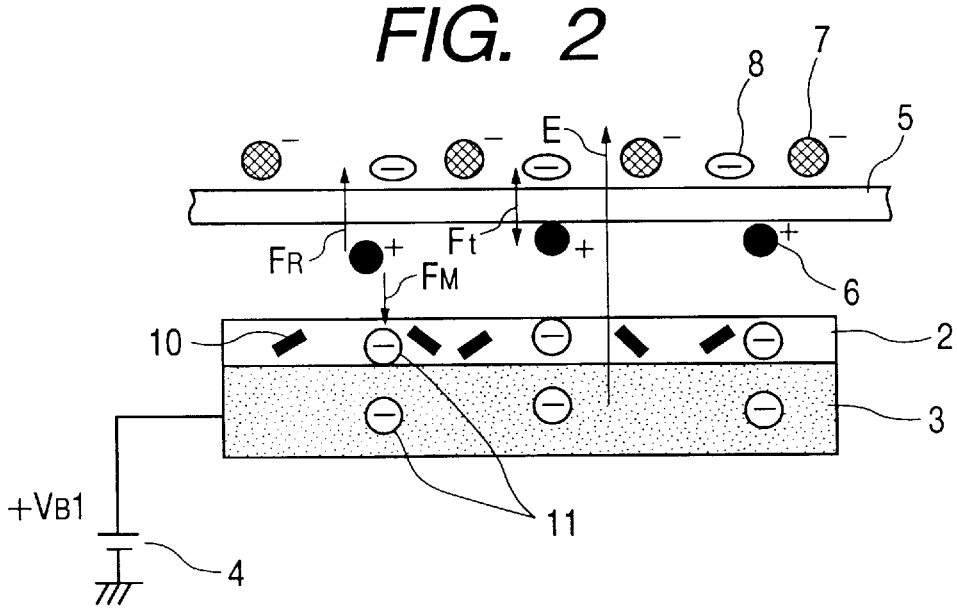
FIG. 2 is a diagram showing a model useful in explaining key points of the present invention.

In the invention, a film made of conductive fluoroplastic, which is formed by dispersing conductive powder 10 of carbon powder, for example, into a fluoroplastic layer 2 as shown in FIG. 2, is formed on the surface of a metal roll 3, although an insulating Teflon film (volume resistivity: at least $10^{16}$ Ωm) is formed on the metal roll in the prior art.

With a change in the added amount of carbon powder, the volume resistivity of conductive fluoroplastic can be varied within a range of $10^2$ to $10^{15}$ Ωm. However, if the amount of carbon powder is added to the degree that the volume resistivity becomes $10^5$ Ωm or less, a release property of the surface of conductive fluoroplastic with respect to toner is deteriorated, whereas if the volume resistivity is $10^{13}$ Ωm or more, an influence of insulation is enhanced.

A positive bias voltage VB1 is applied to the metal roll 3, from an external force source 4.

An unfixed toner image 6, positively charged, is formed on one side of a sheet of paper 5 which is to be in contact with the transport roll. An unfixed toner image 7, negatively charged, and further negative charge 8, which is applied to the paper surface at the time of transferring the unfixed toner image 6, are formed on the other side of the paper. As a result, an electric field E is developed between the paper and the metal roll 3 positively biased. In this case, when a resistance of the fluoroplastic layer 2 is too high, an electric field which is applied to the paper 5 and the toner layers 6, 7 become smaller, and a repulsion (nonattaching force) acting between the paper and the toner 6 is not produced. In the case that a volume resistivity of the fluoroplastic layer 2 is smaller than $10^6$ Ωm, when the resistance of the paper is small, positive charge moves from the metal roll to the toner image 7 on the reverse side of the paper, through the paper. And the amount of charge of the toner image 7 is reduced and the attaching force of the toner image 7 to the paper 5 is reduced. To avoid this, the fluoroplastic layer 2 must be a fluoroplastic film of $10^7$ to $10^{12}$ Ωm in volume resistivity. Specific examples of means to apply voltage to the metal roll are: 1) Voltage is directly applied to the metal roller, from an external power source, and 2) a parallel circuit of a capacitor and a voltage controlled element (e.g., varistor) is connected to between the metal roll and ground, and charge is applied to the transport roll surface by a corona charger. In this case, a surface potential of the transport roll is determined by the characteristic (e.g., a varistor voltage) of the voltage controlled element.

Next, a description will be given of the reduction of an attaching force of toner to the transport roll surface and the increase of an attaching force of toner to the paper.

An attaching force of toner to the transport roll will be described with reference to FIG. 2. When the charged toner 6 is put in close proximity to (in contact with) to the surface of the fluoroplastic layer 2, image charge 11 whose polarity is opposite to the charging polarity of toner is induced in the metal roll 3 and the fluoroplastic layer 2. As a result, an image force $F_m$ which causes the toner 6 to attach to the transport roll surface. Under an electric field E between a positive voltage applied to the metal roll 3 and the negative charge 8 and the toner 7 on the reverse side of the sheet, the transport roll surface 2 and the toner 6 are dynamically coupled with each other by a repulsion $F_R$, and the toner 6 and the negative charge 8 or the negative charge of the toner 7, which is present on the opposite side to the toner 6 with respect to the paper, are dynamically coupled with each other by an attraction force $F_T$. To reduce the soils on the transport roll surface, it is necessary to decrease the image force $F_M$ but increase the repulsion $F_R$ and the attraction force $F_T$.

The image force FM is proportional to a specific inductive capacity, but inversely proportional to the thickness of the fluoroplastic layer.

Figure 3:
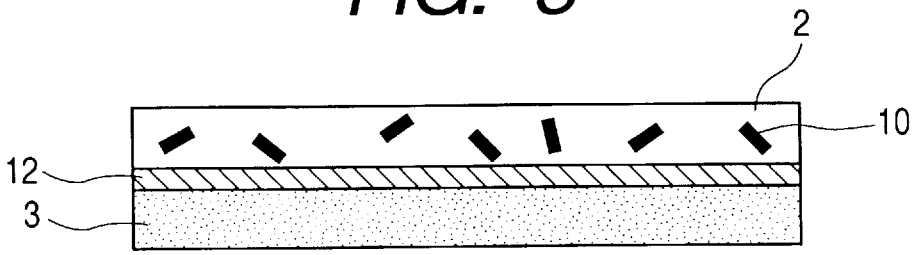
FIG. 3 is a diagram showing another embodiment of a transport roll according to the present invention.

Our study shows that to reduce the image force $F_M$, the relative dielectric constant of the fluoroplastic layer is 80 or less and the thickness of the layer is 30 μm or thicker. If required, a dielectric film 12 may be formed between the metal roll 3 and the fluoroplastic layer as shown in FIG. 3. In this case, the dielectric film 12 is $10^7$ to $10^{12}$ Ωcm in volume resistivity and 80 or less in relative dielectric constant. There is no need for the dielectric film 12, provided under the conductive fluoroplastic layer, to be releasable from the toner. Because of this, the dielectric film may be any of elastic substrates, for example, inorganic and organic films.

An attaching force of the toner 6 (charging polarity: positive) to the paper will be described.

Figure 6:
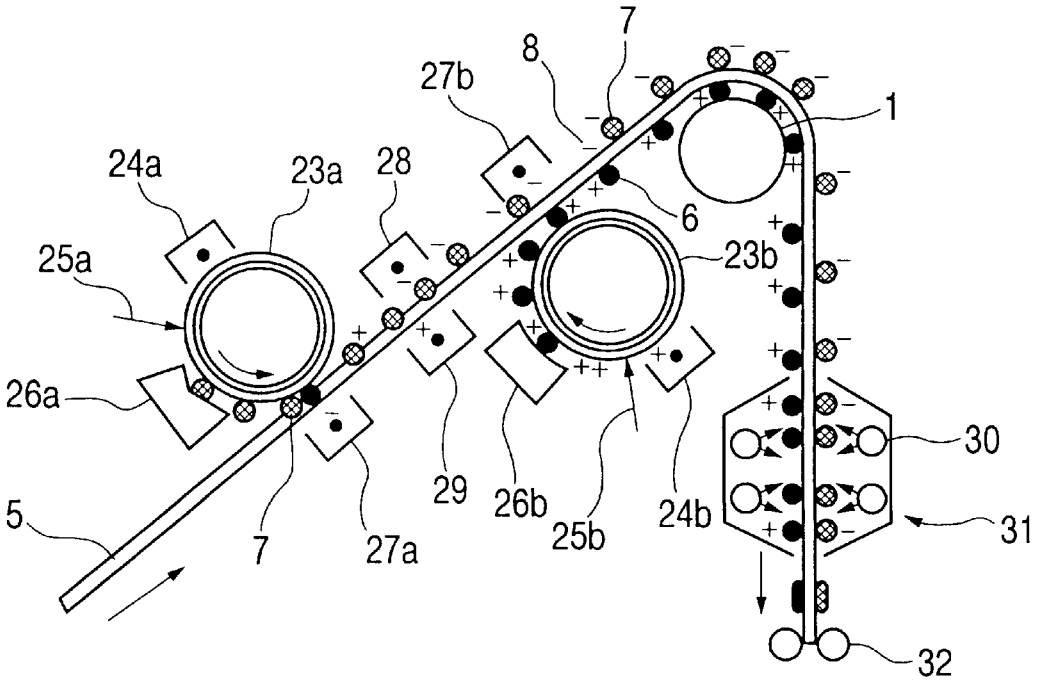
FIG. 6 is a view showing a model of a printer of the duplexing printing type.

In FIG. 6, when the toner 6 is transferred onto the paper, the transfer charge 8 is applied to the toner 7. This transfer charge is the negative charge 8. When the toner moves from the transfer position to the transport roll, the amount of the toner varies depending on ambient conditions, kinds of papers, and the like. Negative charge may be applied, by a corona charger, for example, to the toner so that the reverse side of the paper has a proper amount of charge at the transfer position.

Hereinafter, a description will be given in more detail of preferred embodiments of the invention with reference to the accompanying drawings.

Figure 1:
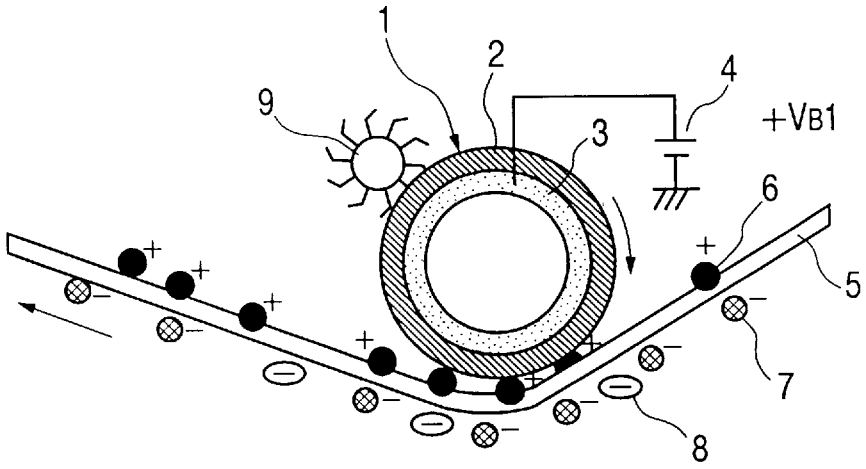
FIG. 1 is a diagram showing a model useful in explaining an embodiment of the present invention.

FIG. 1 shows a diagram showing an embodiment of the present invention. A transport roll 1 consists of a metal roll 3 covered with a tube 2 of conductive PFA (perfluoroalkoxy copolymer). The metal roll 3 is 40 mm in diameter, and the tube 2 is $10^{10}$ Ωcm in volume resistivity and 200 μm thick. The metal roll 3 is connected to a DC voltage source 4. A sheet of paper 5 bearing toner images 6 and 7 on both sides receives a drive force from a paper drive roll (for example, 32 in FIG. 6), and the transport roll 1 rotates with the movement of the paper. That is, the transport roll 1 is driven by the movement of the paper. Voltage produced by the DC voltage source has the same polarity as the charging polarity (positive) of the toner 6 to be in contact with the transport roll. Soils of the transport roll and a toner image on the paper after passing the transport roll were evaluated with a parameter of the voltage VB1 of the DC voltage source in a state that a cleaning means 9 is removed. The results of the evaluation are: When the value of the voltage VB1 is too small, the transport roll is soiled, and when it is too large, a toner image on the paper is disarranged. The results also show a preferable range of the voltage VB1, which is 500 V to 2000 V.

Under this condition, a load to a cleaning means 9, such as brush or a blade, is lessened.

A second embodiment of the transport roll of the present invention will be described with reference to FIG. 3. Aluminum was used for making the metal roll 3. A black anodic oxide coating Alumite was formed, 50 μm thick, on the surface of the metal roll by anodic oxidation process. The anodic oxide coating was $10^9$ to $10^{10}$ Ωcm in volume resistivity and approximately 6 in relative dielectric constant. An adhesive layer of 2 to 3 μm thick was formed on the coating surface, and a conductive PFA tube was applied to the coating surface. The tube was $10^7$ Ωcm in volume resistivity, 20 in relative dielectric constant, and 50 μm in thickness. The anodic oxide coating is hard and its surface is porous. This nature of the coating improves an adhesion between the PFA tube and the metal roll. Since the relative dielectric constant of the anodic oxide coating is small, the image force FM may be reduced.

Figure 4:
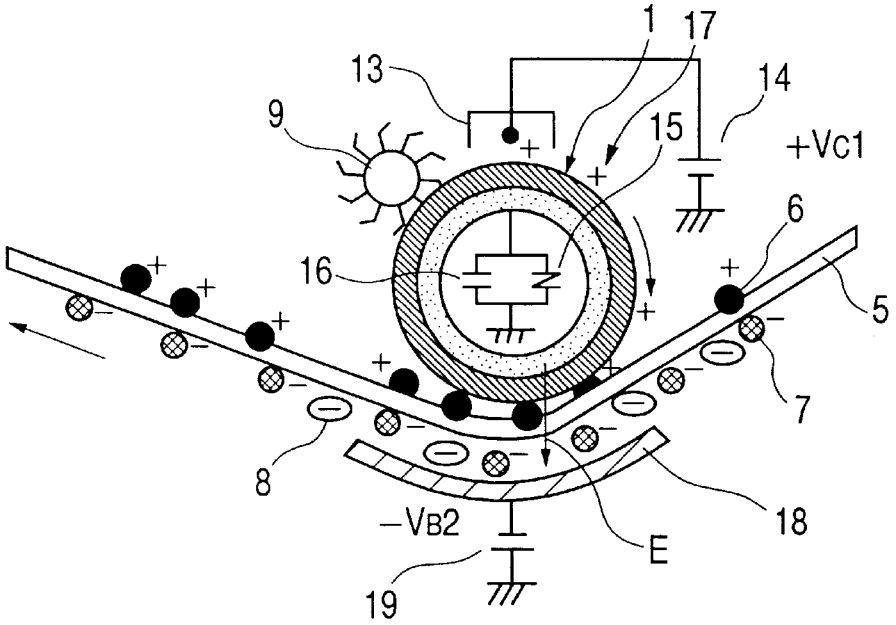
FIG. 4 is a diagram showing yet another embodiment of the present invention.

FIG. 4 is a diagram showing a third embodiment of the present invention. A transport roll 1 consists of a metal roll 3 coated with conductive fluoroplastic, and is the same as in the first embodiment. A parallel circuit of a capacitor 16 (220 pF) and a varistor 15 (varistor voltage Vv: 1000V) is connected between the metal roll body of the transport roll and ground. Corona charge 17, generated by a corona charger 13 connected to a high voltage source 14 ($+14_{C1}$), passes through the conductive fluoroplastic layer 2 of the transport roll, and continuously flows into the capacitor 16 till the voltage across the capacitor 16 reaches a varistor voltage (Vv). The result is that the surface potential of the transport roll is set at 1000V (positive). The thus constructed transport roll has the useful effects comparable with those of the above-mentioned embodiments.

Further, in the present embodiment, an electrode 18 is provided at a location opposite to the transport roll 1 with respect to the sheet 5. A DC power source 19 is connected to the electrode 18. The power source produces negative voltage VB2, which is opposite in polarity to the surface potential of the transport roll.

With provision of the combination of the power source and the electrode, an electric field, directed from the metal roll 3 to the electrode 18, is developed in a region where the sheet 5 comes in contact with the transport roll 1. Because of presence of the electric field, even if the amount of transfer charge 8 (negative) on the reverse side of the paper varies (leaks), a force to move the toner 6 to the reverse side of the paper 5 exists, so that the function of preventing the transport roll from being soiled is stabilized.

The transport roll 1 may be the roll having the anodic oxide coating and covered with the conductive PFA tube, used in the second embodiment.

Figure 5A:
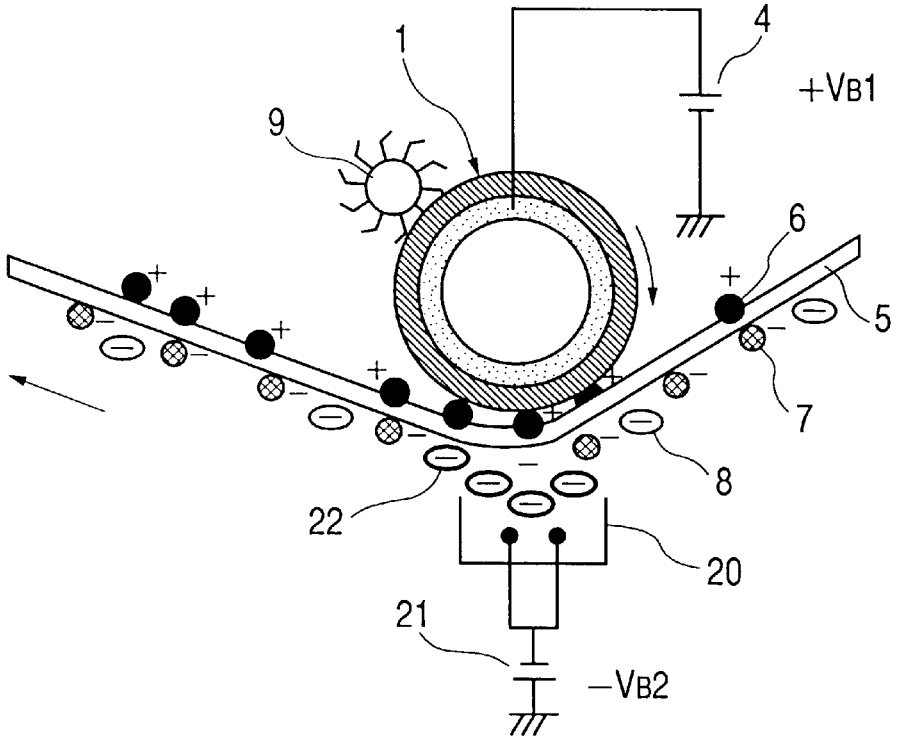
FIGS. 5A and 5B are diagrams showing still another embodiment of the present invention.
Figure 5B:
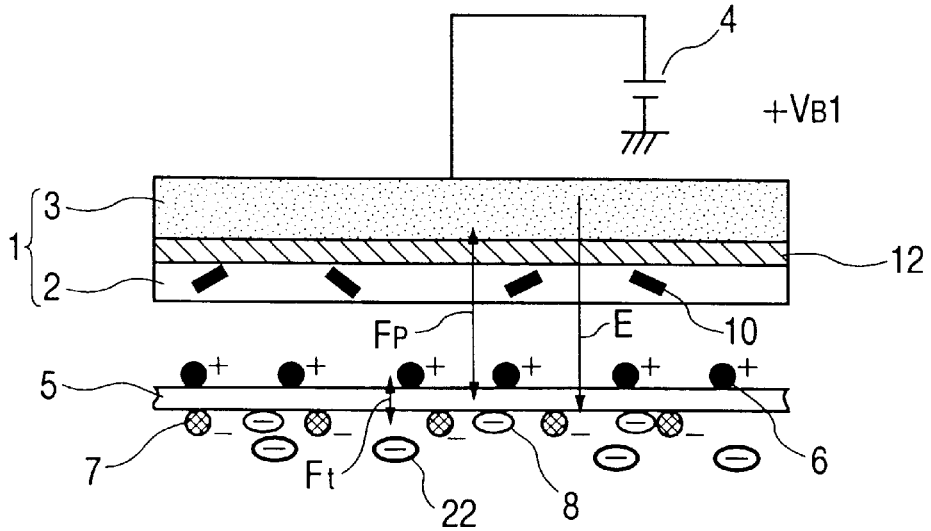
Figure 7:
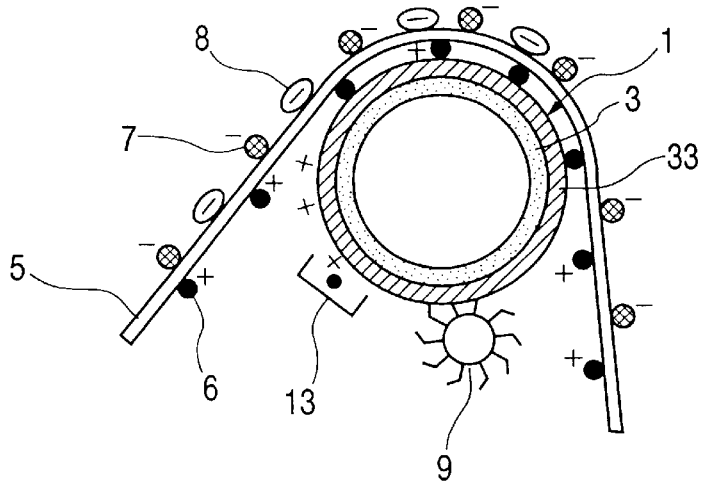
FIG. 7 is a view showing a construction of a conventional transport roll.
Figure 8:
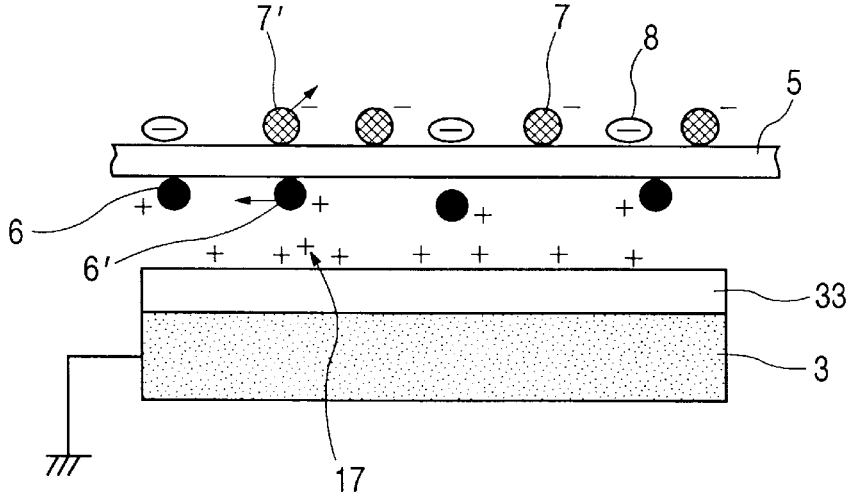
FIG. 8 is a diagram useful in explaining the problems when the conventional transport roll is used.

FIGS. 5A and 5B are diagrams showing a fourth embodiment of the present invention. A construction of the fourth embodiment is shown in FIG. 5A. As in the construction of FIG. 1, positive DC voltage ($+V_{B1}$) is applied to the metal roll of a transport roll 1 covered with a conductive PFA tube. In this example, $+V_{B1}$ is set to 1500 V. In a location where the sheet 5 comes in contact with the transport roll 1, a corona charger 20 is provided in opposition to the transport roll 1. The charger is connected to a DC power source 21 (−VB2), and applies negative charge to the reverse side of the paper. As the result of the application of negative charge 22 to the reverse side of the paper, as shown in FIG. 5B, an adhesion Ft between the toner 6 and the paper 5 is increased, and further an adhesion Fp is created between the sheet 5 and the transport roll 1. The adhesion Fp reduces the amount of toner 6 attached to the transport roll surface. Further, the adhesion Fp prevents the paper 5 from slipping on the transport roll 1. As the cleaning brush 9, it has been found that a lyon brush is excellent in cleaning property in comparison with a nylon brush.

Where the amount of corona charge of the corona charger 20 is too large, the charging polarity of the toner 6 may be inverted. To avoid this, it is preferable to control the charger current. The corona charger 20 may be substituted by a scorotron charger with a grid.

Figure 9:
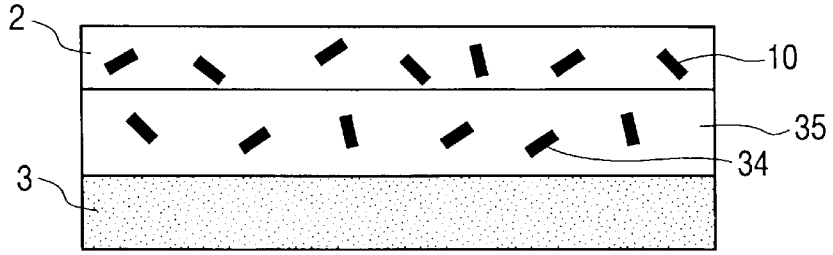
FIG. 9 is a diagram showing another embodiment of the present invention.

FIG. 9 shows a transport roll of a fifth embodiment of the present invention. A conductive rubber layer 35 is formed, 0.1 mm to 10 mm thick, on the surface of the metal roll 3. The rubber layer is mixed with carbon 34, and $10^7$ to $10^{12}$ Ωcm in volume resistivity. The conductive layer is urethane rubber, expanded EPDM (ethylene propylene) rubber or the like. A conductive PFA tube of 100 μm thick is applied to the resultant metal roll. In the thus constructed transport roll, it is possible to secure a sufficient angle at which the sheet 5 comes in contact with the transport roll 1. Therefore, there is a less chance that the paper slips on the roll 1.

Figure 10:
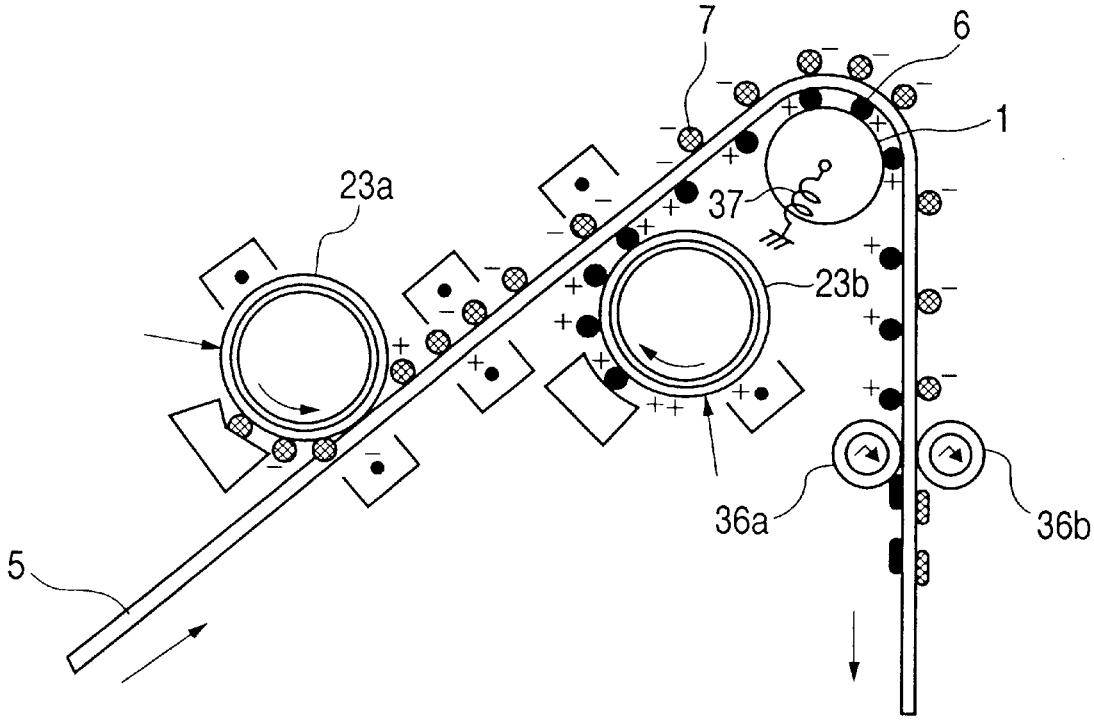
FIG. 10 is a diagram showing another embodiment of the present invention.

FIG. 10 shows a transport roll of a fifth embodiment of the present invention. In case of provision of a pair of heat rolls 36*a* and 36*b* each having a heater therein from a toner fusing unit, a paper is transported while it is held between the heat rolls 36*a* and 36*b*. In the case where the rotating speed of photosensitive drums 23*a* and 23*b* is different from the rotating speed of the heat rolls 23*a* and 23*b*, the paper sags, or inversely tension is applied to the pager. Therefore, a buffer function for absorbing the sagging or tension need be given to the transport roll 1. In this example, a damper 37 such as a spring is disposed on the transport roll 1. This structure makes it possible to prevent the paper from being torn up when the transportation of the paper is rapidly stopped. A non-contact preheater may be disposed upstream of the heat rolls 23*a* and 23*b*. Also, in FIG. 10, although a direction along which the paper is transported is changed by the transport roll 1, the transport roll 1 may not always change the direction along which the paper is transported.

(1) The coating layer on the surface of the transport roll is a conductive fluoroplastic layer of $10^7$ to $10^{12}$ Ωcm in volume resistivity. Therefore, its release properties to toner and the surface potential are stabilized and good in their uniformity. A disarrangement of a toner image being in contact with the transport roll and soils of the transport roll surface are reduced.

(2) The coating layer on the surface of the transport roll is designed so as to have the relative dielectric constant of 80 or smaller and 30 $\mu$m or larger in thickness. With this, an image force can be reduced which will be an attaching force of toner to the transport roll. The attaching force will cause the toner soils on the transport roll.

(3) Charge opposite in polarity to the surface potential of the transport roll is applied to the reverse side of the paper in a location corresponding a location where the paper comes in contact with the transport roll. The result is an increase of the adhesion of the toner to the paper, a decrease of the attaching (soils) of toner to the surface of the transport roll, and there is a less chance of slipping of the paper on the transport roller.

(4) Where any of various underlayers is formed on the conductive fluoroplastic layer on the transport roller, its transporting performance is improved.

When the underlayer is a dielectric layer, for example, an anodic oxide layer, an image force can be reduced. When the underlayer is a rubber layer, the possibility of a slippage of the paper on the transport roll is reduced. In the above-mentioned embodiments, the toner that comes in contact with the transport roll are positively charged. As easily understood, the present invention may also be applied to the case where that toner may be negatively charged. In this case, voltage applied to the transport roll is negative voltage.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrostatographic printing machine of the duplex type, comprising:

a transfer unit for forming unfixed toner images on both sides of a sheet of paper;

a fixing unit for fusing and fixing the unfixed toner images on both sides of the sheet; and a transport roll driven by the movement of the sheet and provided between said transfer unit and said fixing unit, said transport roll for one of (1) changing the direction of transporting the sheet and (2) serving as a buffer when the sheet is transported;

wherein said transport roll comprises a metal roll covered with a conductive fluoroplastic layer; and wherein a parallel circuit consisting of a capacitor and a voltage controlled element is provided between said metal roll of said transport roll and ground, and at a location before a location where the sheet of paper comes in contact with the surface of said transport roll, a corona charger is disposed facing said transport roll, whereby said capacitor is charged under the voltage whose polarity is the same as the charging polarity of said toner image being in contact with said transport roll.

2. An electrostatographic printing machine of the duplex type, comprising:

a transfer unit for forming unfixed toner images on both sides of a sheet of paper;

a fixing unit for fusing and fixing the unfixed toner images on both sides of the sheet; and a transport roll driven by the movement of the sheet and provided between said transfer unit and said fixing unit, said transport roll for one of (1) changing the direction of transporting the sheet and (2) serving as a buffer when the sheet is transported;

wherein said transport roll comprises a metal roll covered with a conductive fluoroplastic layer;

wherein a volume resistivity of said conductive fluoroplastic layer is $10^7$ to $10^{12}$ Ωcm; and wherein a film is formed between said metal roll and said conductive fluoroplastic, said film being 80 or smaller in relative dielectric constant, $10^7$ to $10^{12}$ Ωcm in volume resistivity, and 30 $\mu$m or larger in thickness.

3. The electrostatographic printing machine according to claim 2, in which said metal roll is aluminum, and the surface of said metal roll is anodized and then a conductive fluoroplastic layer is formed thereon.

4. The electrostatographic printing machine according to claim 2, in which an elastic layer is formed on the surface of said metal roll, and a conductive fluoroplastic layer is formed on said elastic layer.

* * * * *